US008727460B2

(12) United States Patent
Grabher

(10) Patent No.: US 8,727,460 B2
(45) Date of Patent: May 20, 2014

(54) PIECE OF FURNITURE AND DEVICE FOR A PIECE OF FURNITURE

(75) Inventor: Günter Grabher, Fussach (AT)

(73) Assignee: Grass GmbH, Hochst (AT)

( * ) Notice: Subject to any disclaimer, the term of this patent is extended or adjusted under 35 U.S.C. 154(b) by 0 days.

(21) Appl. No.: 13/526,801

(22) Filed: Jun. 19, 2012

(65) Prior Publication Data

US 2012/0311818 A1 Dec. 13, 2012

Related U.S. Application Data

(63) Continuation of application No. PCT/EP2010/007666, filed on Dec. 16, 2010.

(30) Foreign Application Priority Data

Dec. 21, 2009 (DE) ..... 20 2009 017 319 U

(51) Int. Cl.
*A47B 88/00* (2006.01)

(52) U.S. Cl.
USPC ..... 312/333

(58) Field of Classification Search
USPC ..... 312/334.4–334.6, 334.27, 333, 334.8, 312/334.14, 334.1, 350, 330.1; 384/22
See application file for complete search history.

(56) References Cited

U.S. PATENT DOCUMENTS

| | | | | |
|---|---|---|---|---|
| 3,087,771 | A * | 4/1963 | Pari | 312/332 |
| 3,501,866 | A * | 3/1970 | Johnson | 49/380 |
| 6,913,334 | B2 * | 7/2005 | Weichelt | 312/334.4 |
| 6,930,887 | B2 * | 8/2005 | Hartman | 361/727 |
| 7,185,959 | B2 * | 3/2007 | Mueller et al. | 312/331 |
| 7,234,569 | B2 * | 6/2007 | Salice | 188/130 |
| 7,708,358 | B2 * | 5/2010 | Embacher | 312/333 |
| 7,748,799 | B2 * | 7/2010 | Kleinsasser | 312/319.1 |
| 8,052,233 | B2 * | 11/2011 | Netzer et al. | 312/330.1 |
| 8,100,487 | B2 * | 1/2012 | Liang et al. | 312/333 |
| 8,336,973 | B2 * | 12/2012 | Berger | 312/334.4 |
| 8,413,298 | B2 * | 4/2013 | Domenig et al. | 16/85 |

(Continued)

FOREIGN PATENT DOCUMENTS

| | | |
|---|---|---|
| DE | 202 00 798 U1 | 5/2002 |
| DE | 203 21 444 U1 | 5/2007 |
| DE | 20 2007 006 549 U1 | 8/2007 |
| DE | 20 2006 006 178 U1 | 10/2007 |

OTHER PUBLICATIONS

German Search Report dated Nov. 23, 2010.

(Continued)

*Primary Examiner* — Janet M Wilkens
(74) *Attorney, Agent, or Firm* — Burr & Brown, PLLC

(57) ABSTRACT

A device for a piece of furniture that has a furniture part accommodated in a movable manner on a basic furniture structure, for the device defining a stop position of the furniture part, an including an adjustment unit having an adjustable stop part, which bounds a furniture-part closing movement executed during normal operation, wherein the stop part is deflected resiliently out of a starting position, and wherein the stop position is determined by the extent of deflection in a fixed deflecting position of the stop part.

11 Claims, 7 Drawing Sheets

(56) References Cited

U.S. PATENT DOCUMENTS

| | | | | |
|---|---|---|---|---|
| 2005/0235823 | A1* | 10/2005 | Zimmer | 92/109 |
| 2006/0103279 | A1* | 5/2006 | Lai | 312/333 |
| 2008/0265729 | A1* | 10/2008 | Netzer et al. | 312/330.1 |
| 2008/0303397 | A1* | 12/2008 | Chen et al. | 312/334.46 |
| 2009/0236959 | A1* | 9/2009 | Liang et al. | 312/334.4 |
| 2012/0306337 | A1* | 12/2012 | Hammerle | 312/334.8 |
| 2013/0077900 | A1* | 3/2013 | Lowe et al. | 384/18 |

OTHER PUBLICATIONS

International Search Report and Written Opinion dated Apr. 8, 2011.

* cited by examiner

PIECE OF FURNITURE AND DEVICE FOR A PIECE OF FURNITURE

CROSS REFERENCE TO RELATED APPLICATIONS

This application is a continuation of International Application No. PCT/EP2010/007666 filed Dec. 16, 2010, which designated the United States, and claims the benefit under 35 USC §119(a)-(d) of German Application No. 20 2009 017 319.4 filed Dec. 21, 2009, the entireties of which are incorporated herein by reference.

FIELD OF THE INVENTION

The invention relates to piece of furniture and a device for a piece of furniture.

BACKGROUND OF THE INVENTION

For pieces of furniture with a furniture part accommodated in a movable manner on a basic furniture structure, it is known to have devices with an adjustment unit for defining a closing position of the furniture part. The adjustment unit makes it possible to predetermine the end point of a furniture-part closing movement, which can be executed during normal operation of the piece of furniture, by the provision of an adjustable stop which defines the end point. This is necessary, in particular, for pieces of furniture with furniture parts, e.g. drawers, which, in the closed state, can be recessed to their full extent in an accommodating volume of the basic furniture structure. It is customary here for a front side of the furniture part not to project beyond an end side of the basic furniture structure. Furniture parts with a recessible front side, in the case of drawers, are also referred to as "inset drawers". It is possible here for a front panel to be reduced such that there are no peripheral regions projecting on side walls or a floor of the drawer. It is thus also the case that the projections of the peripheral regions on the front of the drawer, being absent, cannot serve as an abutment surface for contact with a stop, e.g. with an end surface of the basic furniture structure. This means that there is no possible way of defining an end point for the closing movement of the furniture part on the front side of the furniture part or on the basic furniture structure. An end point for the closing movement therefore has to be predetermined at some other location.

Depending on production tolerances of components and/or deviations in the installation accuracy, for example, of a guide device for the movable furniture part, it may also be the case that the furniture part, in the closed state or in the stop position, is not located in a desired closing position or has been retracted into the basic furniture structure to a different extent in relation to further and/or adjacent furniture parts. This usually results in the front of the piece of furniture being of non-uniform appearance.

SUMMARY OF THE INVENTION

It is an object of the present invention, in the case of pieces of furniture of the type mentioned in the introduction, for it to be possible to predetermine a closing situation to an improved extent.

The invention proceeds, in the first instance, from a device for a piece of furniture, which comprises a furniture part accommodated in a movable manner on a basic furniture structure, wherein the device serves for defining a stop position of the furniture part, having an adjustment unit, which has an adjustable stop and which bounds a furniture-part closing movement which can be executed during normal operation. An essential aspect of the invention is that the adjustment unit comprises a stop part which can be deflected resiliently out of a starting position, wherein the stop position is determined by the extent of deflection in a fixed deflecting position of the stop part. According to the invention, it is advantageously possible for a stop position for the furniture part to be set straightforwardly when the furniture part, which is accommodated in a movable manner, is in the closed state. The adjustment unit may be connected to the movable furniture part or to the basic furniture structure in a fixed position, in particular, directly or also indirectly. The deflectable stop part, in turn, may be supported directly or indirectly on the correspondingly other component of the piece of furniture, that is to say either on the movable furniture part or on the basic furniture structure. For the purpose of defining the stop position, the stop part can be deflected from the starting position, in principle, in two opposite deflecting directions and is fixed in a predeterminable deflecting position. However, it is also possible for the stop part to be deflected from the starting position in just one direction. With boundary conditions being otherwise comparable, the maximum adjustment path that can be covered may be greater in the first case, for example double the size, than in the second case.

In particular, it is advantageous when at least one of the defining device or the adjustment unit is designed as a component. This component, depending on the use, may be provided optionally at different locations.

The device is advantageous, in particular, for a piece of furniture which comprises a front side with a furniture-part front and a basic-furniture-structure front, and the outer dimensions of the furniture-part front are smaller than the outer dimensions of a free cross section of an accommodating opening at the front of the basic furniture structure, which is followed by a space for accommodating the furniture part in the basic furniture structure. It is thus the case that, when the furniture part moves, the furniture-part front is spaced apart, via a comparatively small gap, from portions of the basic furniture structure which bound the accommodating opening. This relates to, for example, reduced drawers or "inset drawers", which, rather than having a broad front panel, merely have a front panel which is as wide or high as the outer dimension of the drawer body defined by the side parts and the floor of the drawer. The adjustment unit according to the invention advantageously makes it possible to set precisely flush recessing of the front side of the furniture part in relation to an end surface of the basic furniture structure and/or in relation to a plane which is aligned therewith or parallel thereto.

The resiliently deflectable stop part allows a stop position to be set particularly straightforwardly and precisely or, in particular, in a stepless manner.

Operation of the adjustment unit by an individual takes place, for example, using a straightforward tool or preferably without any tools being used, in particular by a simple hand movement.

It is particularly preferred when the adjustment unit is present on a coupling means in order for the furniture part to be fitted, in particular in a latchable and releasable manner on a movement rail assigned to the furniture part. The coupling means may be designed, for example, as a latching coupling, which is fastened on the underside of a furniture-part floor and, in the installed state, latches into a latching-in portion on the movement rail. Such add-on parts are present in any case and are particularly suitable for accommodating the adjustment unit. Therefore, installation of the adjustment unit readily takes place as the latching coupling is fitted. Moreover, the adjustment unit is usually freely accessible for operation on the underside of the furniture part. With the furniture part closed, the stop part of the adjustment unit is then in operative connection with the basic furniture structure or a guide rail on the basic furniture structure.

The extent of deflection of the stop part can preferably be predetermined by a changeable-position regulating element which acts on the stop part. It is therefore possible, for example even in the case of constricted space conditions in the region of the stop part, for the latter to be adjusted from a location at a distance therefrom. All that is required for this purpose is for the changeable-position regulating element to be subjected to appropriate action directly or indirectly, which can take place in different ways. The regulating element can thus bridge at least the significant distance between the location of action or operation and the stop part.

Furthermore, it is proposed that the adjustment unit comprises a basic body with the stop part formed resiliently thereon and the regulating element guided on the basic body. It is thus possible for the adjustment unit to be constructed in a compact manner from a single component.

Furthermore, it is advantageous when an operating element, which is mounted for rotation about an axis of rotation, is provided such that rotation of the operating element causes displacement of the regulating element. It is thus possible for straightforward rotary adjustments, for example by hand, to give rise to displacement of the regulating element and thus to provide precise fine adjustment of the deflection, or of the extent of deflection, of the stop part.

Moreover, it is advantageous when the operating element and the regulating element are coordinated with one another such that the axis of rotation of the operating element runs transversely to a displacement direction of the regulating element. It is thus possible, even in the case of spatially difficult boundary conditions, for the regulating element to be displaced in a direction in which it is not possible to act directly on the regulating element. Rather, the regulating element can be displaced by lateral action, even at a correspondingly greater distance.

In particular, it is advantageous to provide a wedge-gear-mechanism arrangement, via which the rotary movement of the operating element is converted into an adjustment movement of the regulating element. A wedge-gear-mechanism arrangement is particularly space-saving, straightforward and reliable.

Furthermore, it is advantageous when a first threaded portion is present on the operating element, a second threaded portion is present on the regulating element, and these two threaded portions are coordinated with one another in order to change the position of the regulating element when the operating element is rotated. It is thus possible for an individual to rotate the operating element particularly sensitively, and the regulating element is changed in position, for example displaced, and the stop part can be deflected, in a correspondingly very sensitive or stepless manner. The deflection of the stop part can be adjusted, for example, in the range of a fraction of a millimeter.

Furthermore, it is proposed that the operating element and the regulating element are coordinated with one another such that the axis of rotation of the operating element is oriented parallel to the displacement axis of the regulating element. This means that, in spatial terms, operation can also be carried out in extension of the longitudinal axis of the regulating element. It is also possible, in this way, for the adjustment unit to be of very space-saving and/or straightforward configuration.

A further essential aspect of the invention is that the adjustment unit comprises a rotatable operating element by means of which a stop part, which is accommodated in a displaceable manner, can be adjusted in order for the stop position to be determined by the extent of displacement of the stop part, where the axis of rotation of the operating element is oriented in the direction of displacement of the stop part. The displacement arrangement makes it possible to realize a particularly stable design. In contrast to the deflectable stop part, there is no need for any articulation, as a result of which the adjustment unit may be of particularly straightforward and compact design. Nevertheless, here too, very sensitive adjustment of the stop part is possible, as is fine adjustment in respect of the position of the closed furniture part.

A rotation-prevention means is advantageously provided for the stop part, which is accommodated in a displaceable manner. It can thus be ensured that rotation of the operating element does not give rise to the stop part being rotated along therewith when the two parts are in meshing engagement with one another, e.g. via a threaded arrangement, for an adjustment movement. With the interaction via the coordinated threaded portions on the operating element and the stop part, it is additionally possible to realize a self-locking or securing arrangement. Any vibration which may occur during operation and/or impact-like forces generated during the closure of the furniture part cannot give rise to any undesired adjustment of the stop part.

In principle, it is advantageously also possible, in this respect, to provide a different and/or separate arrangement for automatically securing a set point of the stop part.

It is advantageous, in addition, when a releasably fitted contact portion is present on the stop part, it is this contact portion that comes into stopping contact, in a stopping situation, with an abutment portion. It is thus possible, for example for a contact portion formed from a particular resistant material to be provided, and in particular also in an exchangeable manner, so that, if appropriate, a damaged contact portion can easily be exchanged.

The invention also relates to a piece of furniture with one of the devices discussed above.

It is thus advantageously possible on a piece of furniture, for example, with a basic furniture structure accommodating a plurality of movable drawers of reduced front-part dimensions, or accommodating a plurality of inset drawers, for a closing or stop position, with the drawer in the closed position in the basic furniture structure, to be adjusted sensitively for each drawer by a respectively associated adjustment unit. As a result, it is possible to set up, with millimeter accuracy, a front side of the piece of furniture with all the drawers having precisely aligned front surfaces, which is advantageous, in particular, from a visual point of view.

BRIEF DESCRIPTION OF THE DRAWINGS

Further advantages and features of the invention will be explained in more detail hereinbelow with reference to various exemplary embodiments according to the invention which are shown in the figures.

DETAILED DESCRIPTION OF THE INVENTION

Figure 1:
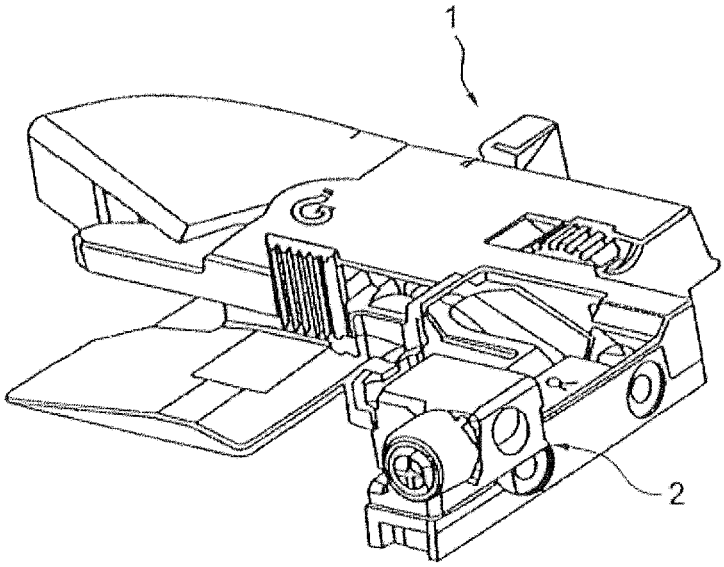
FIG. 1 shows a perspective illustration of a latching coupling with an adjustment unit according to the invention.
Figure 2:
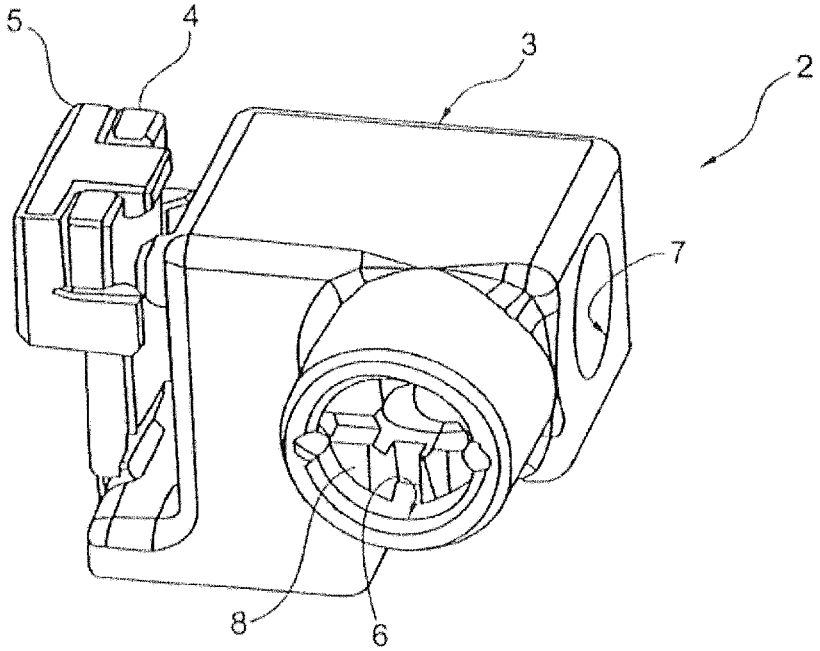
FIG. 2 shows, on an enlarged scale, a perspective illustration of the adjustment unit from FIG. 1.
Figure 3:
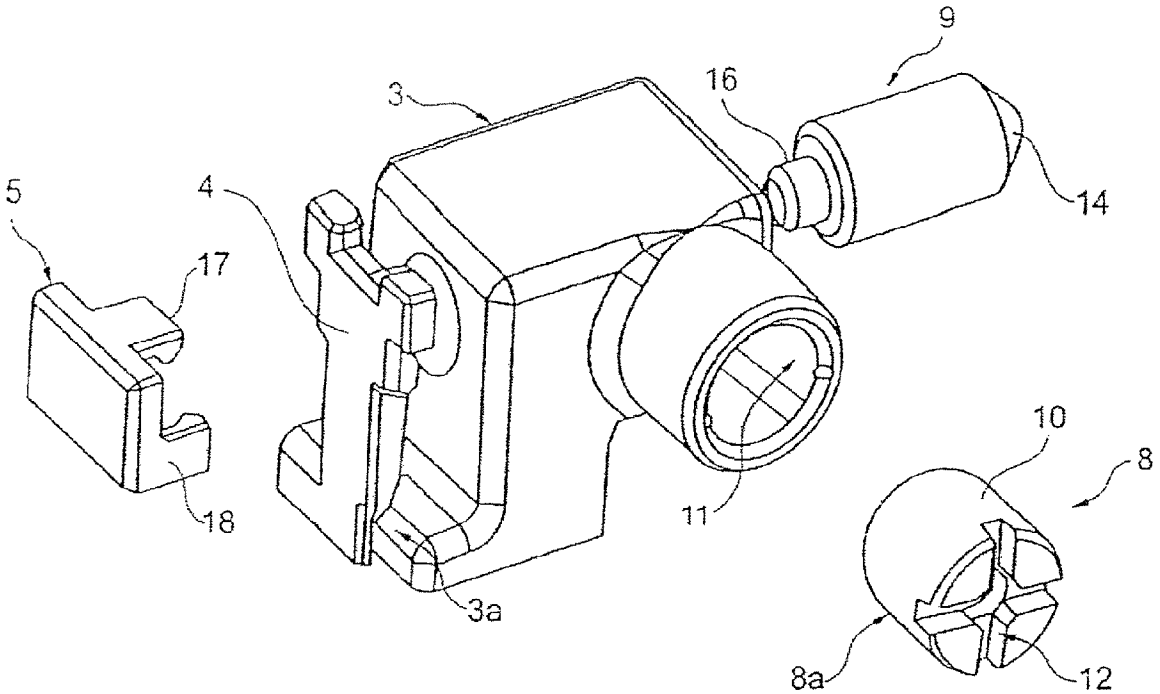
FIG. 3 shows an exploded illustration of the adjustment unit from FIG. 2.

FIG. 1 shows a latching coupling 1 (not described any more specifically) with a bracket or adjustment unit 2 according to the invention present thereon. The latching coupling 1 is fitted, for example, on an underside of a drawer of a piece of furniture and serves for connecting the drawer in a latchable manner to a drawer rail, which serves for guiding the drawer in a displaceable manner on a basic furniture structure. The drawer rail is part of a known telescopic full-extension or partial-extension mechanism having guide rails which can be moved relative to one another, and is fixed in position on the basic furniture structure.

The adjustment unit 2 may be accommodated, for example, in a releasable, but fixed, manner on the latching coupling 1.

The adjustment unit 2 is produced, in particular, from plastics material and comprises a basic body 3 with a deflectable stop part, which is formed integrally on the basic body and is configured, for example, as a stop tongue 4, which has a flexural articulation provided in its foot region.

FIGS. 1 to 6 each illustrate a neutral starting position of the stop tongue 4, or a position in which the latter is not flexed and/or not deflected. This corresponds to a setting in which the furniture part, in the closing position, can be retracted to the maximum extent in the basic furniture structure.

A cap-like and/or releasably plugged-on contact portion 5 is present at the upper free end of the stop tongue 4. Also present in the basic body 3 are accommodating bores 6, 7 which are oriented at right angles to one another, pass through one another and the central axes of which intersect. The accommodating bore 6 accommodates an operating element 8, which is designed as a regulating screw 8 and interacts with an adjustment bolt 9, which can be moved in a displaceable manner in the accommodating bore 7 and serves as a regulating element of the adjustment unit 2.

The regulating screw 8 has, on its cylindrical outer lateral surface 8*a*, an external thread 10 (not illustrated), which is coordinated with an internal thread 11 (not shown either) in the accommodating bore 6. It is thus possible, by virtue of rotation of the regulating screw 8, for the latter to be screwed into the accommodating bore 6, and unscrewed therefrom, to different extents, depending on the direction of rotation. For this purpose, it is possible, for example, for a rotating tool to be applied to a cross-slot-like engagement contour 12 on the outside, and at the end, of the regulating screw 8.

Figure 4:
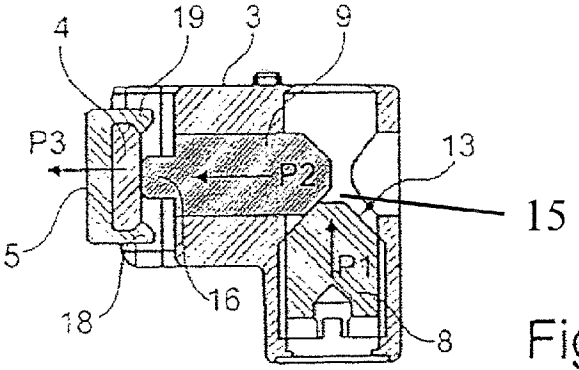
FIG. 4 shows a sectional view through the adjustment unit from FIG. 2.

Rotation of the regulating screw 8 allows the latter to be moved in arrow direction P1 (see FIG. 4), and therefore cause sliding contact between a chamfer 13 running around the front of the regulating screw 8 and a matching chamfer 14 running around the adjustment bolt 9, which gives rise to displacement of the adjustment bolt 9 in arrow direction P2 (FIG. 4). The chamfers 13, 14 form active force-transmission or movement-transmission surfaces of a wedge-gear-mechanism arrangement 15 between the regulating screw 8 and the adjustment bolt 9.

A contact nose 16, which is directed toward the stop tongue 4, is located at the front of the adjustment bolt 9, and is guided with sliding action in the accommodating bore 7, to thus come into contact with a free upper end of the stop tongue 4 (see FIG. 4). This means that the stop tongue 4 which can be deflected resiliently in an articulated manner on a base portion 3*a* of the basic body 3, is deflected, with flexing action, in the direction of arrow P3 in FIG. 4. The contact portion 5 is also moved in the direction of arrow P3, and thereby defines a deflecting position or an extent of deflection of the stop tongue 4, and a change in position of the stop tongue 4 and of the contact portion 5 are defined. The extent of deflection set correspondingly defines a mechanical stop for a closing movement of the furniture part, which is accommodated in a movable manner on a basic furniture structure.

The bending characteristics of the stop tongue 4 can be predetermined and/or coordinated by the type or shape, e.g. the material thickness in the foot region of the stop tongue 4 and/or the material selection, of the flexing regions.

The contact nose 16 is cylindrical and of reduced diameter in relation to the diameter of that part of the adjustment bolt 9 which can be displaced in the accommodating bore 7. In order for the stop tongue 4 to be flexed, the adjustment bolt 9 has to overcome a spring force or opposing force which acts as a result of the flexing of the stop tongue 4. In the flexed or deflected state of the stop tongue 4, the adjustment bolt 9 is subjected permanently to this opposing force. This provides for a self-locking action which, when the regulating screw 8 is not actuated, prevents the adjustment bolt 9 from moving back in the direction counter to the arrow P2 and is realized via the external thread 10 and internal thread 11, which are in meshing engagement.

The adjustment unit 2 described allows a large number of different stop positions to be set in a sensitive manner. It is thus possible to define the closed state of a front side of the movable furniture part with millimeter accuracy.

The stop tongue 4 is limited in its deflection path according to arrow P3 wherein a deflection path from the starting position shown to a maximum deflection is within a range of a number of millimeters to more than a centimeter. The deflection path correlates, as per P1, with the adjustment path of the regulating screw 8 in the accommodating bore 6 and, as per P2, with the displacement path of the adjustment bolt 9 in the accommodating bore 7.

In order for the somewhat elastic contact portion 5 to be clipped in on the upper region of the stop tongue 4, the stop tongue 4 is provided corresponding with incisions or shoulders, which are coordinate with corresponding, slightly compliant fastening jaws 17, 18 and 19 on the contact portion 5. In addition, the contact portion 5 may be of mechanically damping and/or noise-reducing design, for example it may consist of an elastomer material or rubber material.

FIG. 4 shows a horizontal section through the adjustment unit 2 taken through a plane in which the longitudinal axes of both the regulating screw 8 and the adjustment bolt 9 are located.

Figure 5:
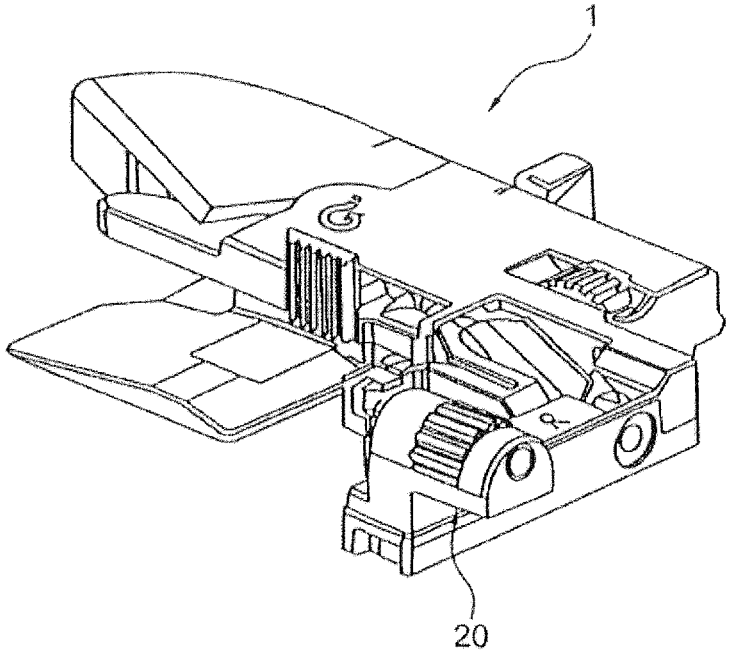
FIG. 5 shows a perspective view of the latching coupling from FIG. 1 with an alternative adjustment unit according to the invention.
Figure 6:
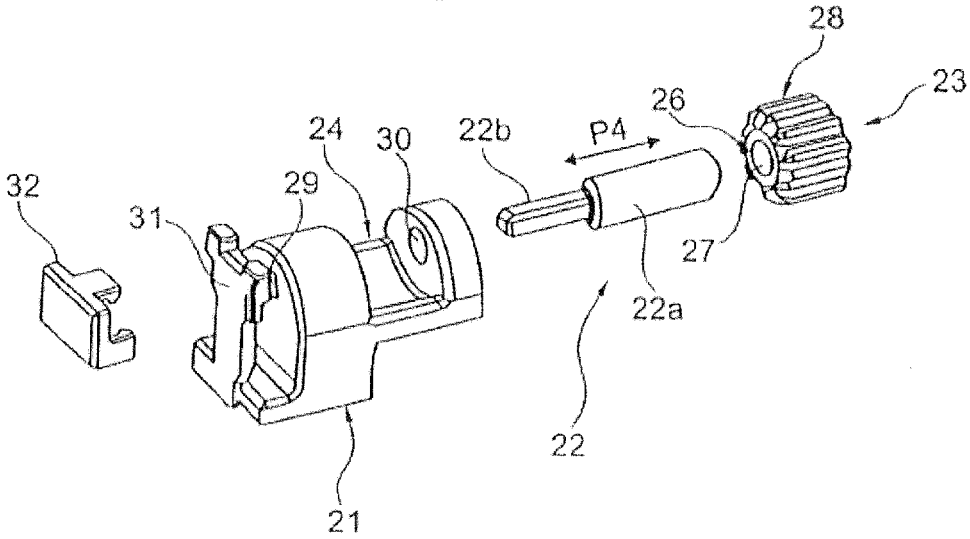
FIG. 6 shows an exploded illustration of the adjustment unit from FIG. 5.

FIG. 5 shows, on a latching coupling 1 according to FIG. 1, an alternative adjustment unit 20 according to the invention, having a stop tongue 31 which can be deflected resiliently in a manner corresponding to the exemplary embodiment according to FIGS. 1 to 4. The adjustment unit 20 corresponds to the basic functional principle of the adjustment unit 2. It is merely the arrangement for acting on the stop tongue 31 which is different. The adjustment unit 20 has a basic body 21 and a displaceably mounted adjustment bolt 22 secured against rotation therein. The displacement direction (P4) of the adjustment bolt 22 corresponds to the deflecting direction of the stop tongue 31. For manual displacement of the adjustment bolt 22 in the longitudinal direction thereof, an adjustment wheel 23 is provided on the basic body, partially recessed in an accommodating hollow 24. The adjustment wheel 23, which is configured as a pinion, has a through-passage bore 26 with an internal thread 27, which interacts with a threaded portion 22*a* formed on the outside of the adjustment bolt 22, or the adjustment wheel 23 has been screwed on the adjustment bolt 22. A toothed portion 28 is formed circumferentially around the outside of the adjustment wheel 23, in order to provide for better manual operation of the adjustment wheel 23. The front end of the adjustment bolt 22, which is directed toward the stop tongue 31, is configured as a quadrilateral portion 22*b* that, in the assembled state of the adjustment unit 20, engages with a small amount of play through a matching quadrilateral hole 29 in the basic body 21 and has its end positioned on an inner side of the stop tongue 31. On that side of the basic body 21, which is opposite to the stop tongue 31, moreover, an accommodating opening 30 is present for bearing the adjustment bolt 22 with an end region of the threaded portion 22*a* being supported in this accommodating opening 30.

Figure 9:
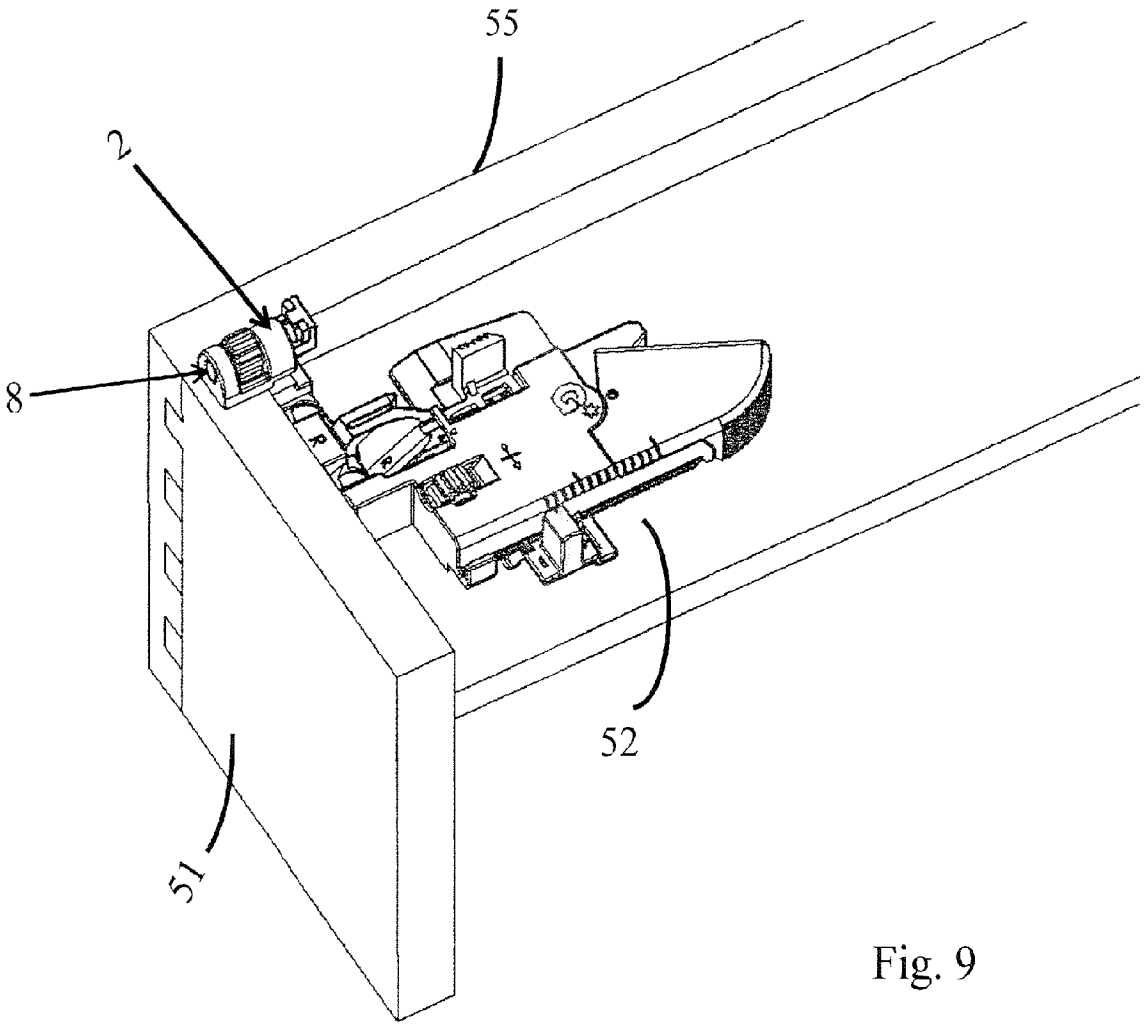
FIG. 9 shows the embodiment of the latching coupling shown in FIG. 5 attached to the underside front portion of a moveable furniture part from the bottom side.
Figure 10:
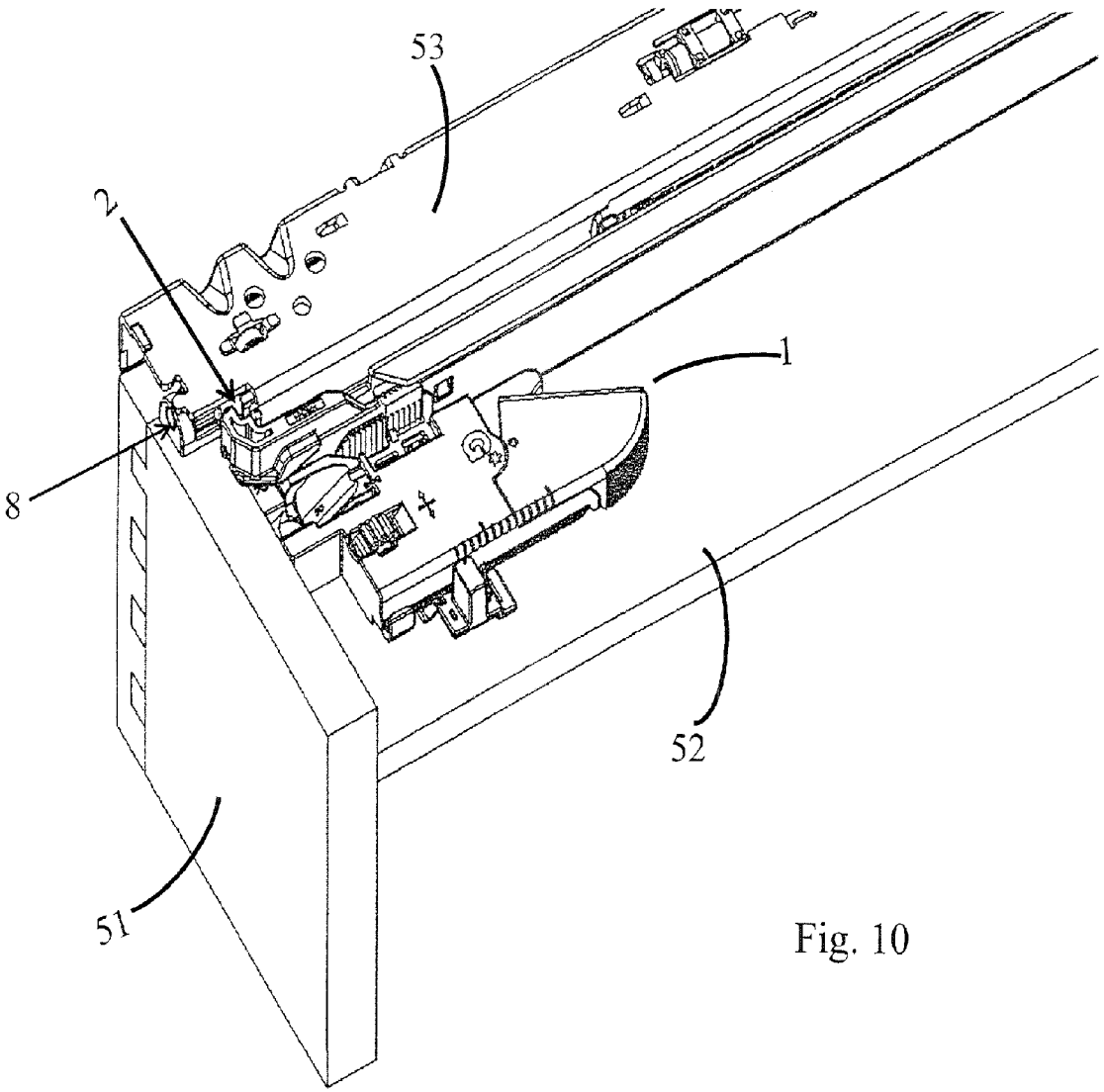
FIG. 10 shows the embodiment of the latching coupling shown in FIG. 5 connected in a latchable manner with a drawer rail of the furniture rail structure 53 with only a lower face of the furniture rail assembly visible.
Figure 11:
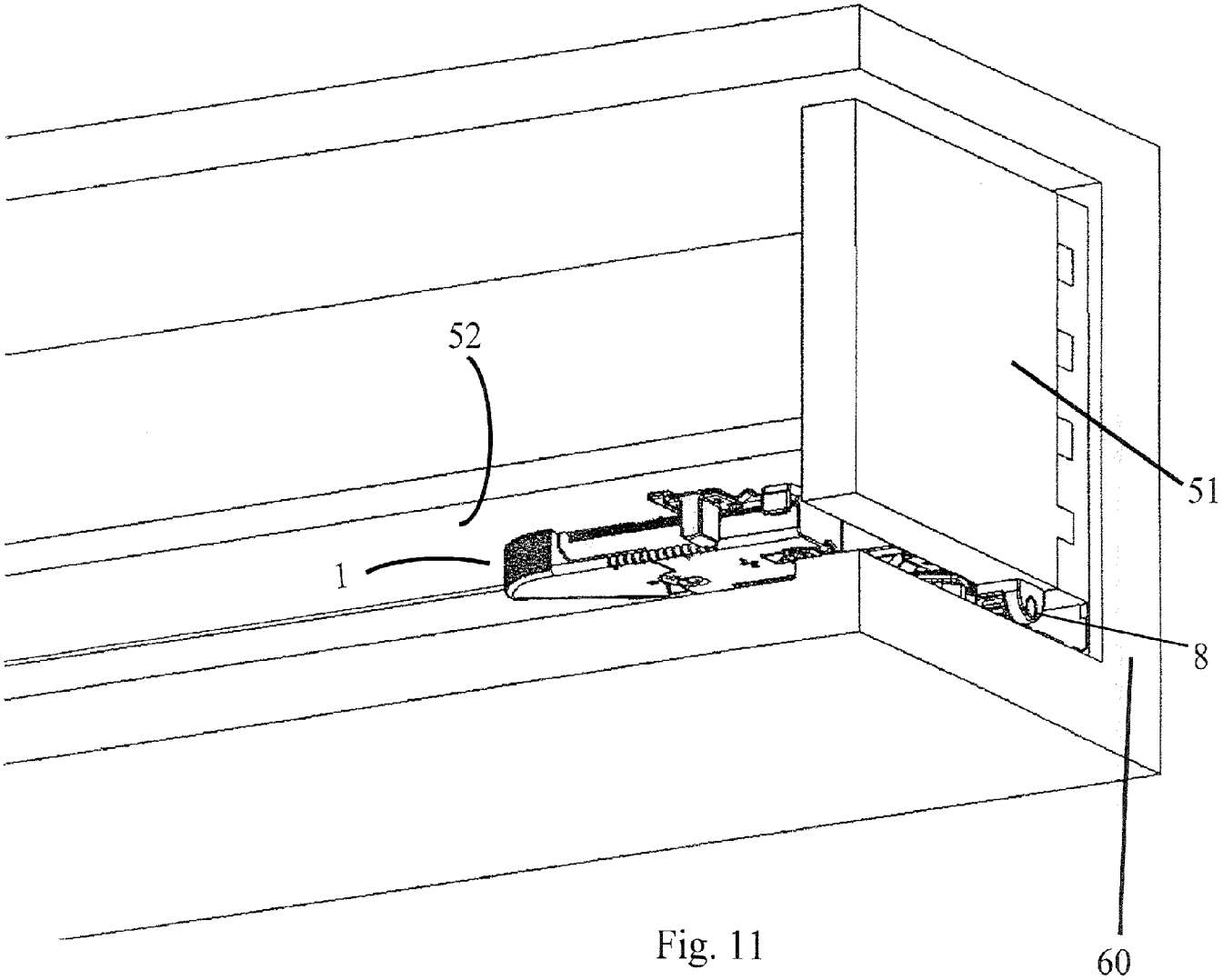
FIG. 11 shows the embodiment of the latching coupling shown in FIG. 5 in a stop position with the moveable furniture part in a fully closed position relative to the basic furniture structure with the front face of the drawer removed and the contact portion in operative contact with a guide rail of the furniture rail structure 53.

Manual rotation of the adjustment wheel 23 allows the adjustment bolt 22 to be displaced in the direction of double arrow P4 relative to the basic body 21. This means that the stop tongue 31 is also deflected resiliently and retained in the flexed position reached. A contact portion 32 is also present on the stop tongue 31. The latching coupling attached to the underside of a front portion of a drawer (moveable furniture part) from the bottom side is shown in FIG. 9. The latching coupling is shown in more detail in FIG. 5. The latching coupling is shown latchably connected to a drawer rail of the furniture rail structure 53, fixed in position on the basic furniture structure in FIG. 10. In FIG. 10, the furniture rail structure 53 is shown from below and only the bottom surface of the furniture rail structure is visible. The latching coupling is shown with the drawer (moveable furniture part with a front face of the drawer removed) in a fully closed position relative to the basic furniture structure 60. In FIG. 11, the drawer is connected to the moveable rail and the contact portion of the stop part is in operative contact with the guide rail of the furniture rail structure 53 (moveable furniture part) and is adjustable via operative element 8.

Figure 7:
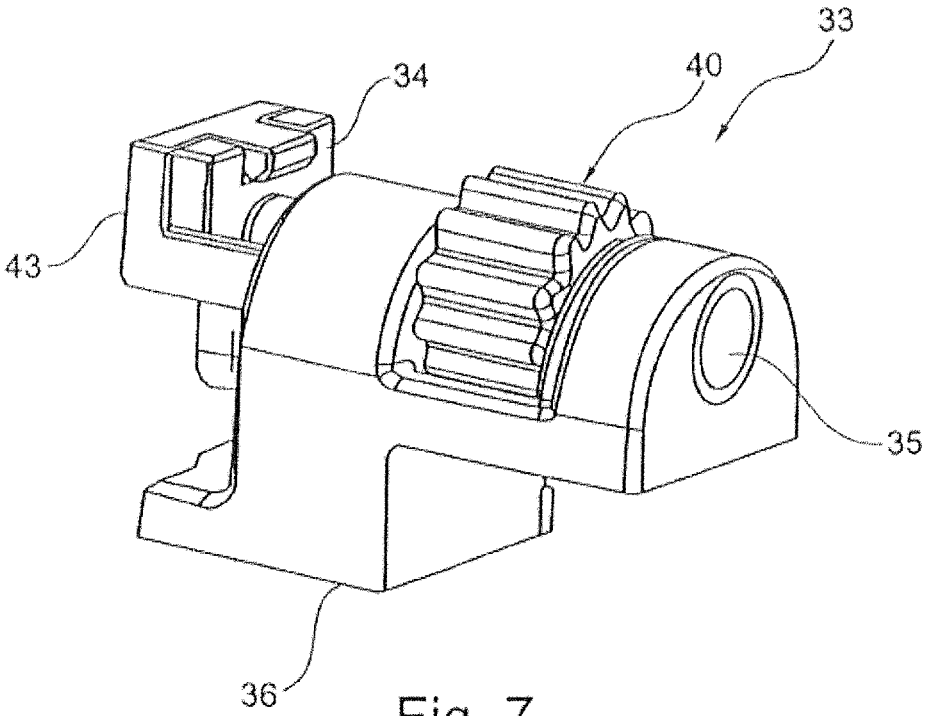
FIG. 7 shows a perspective view of a further alternative adjustment unit according to the invention.
Figure 8:
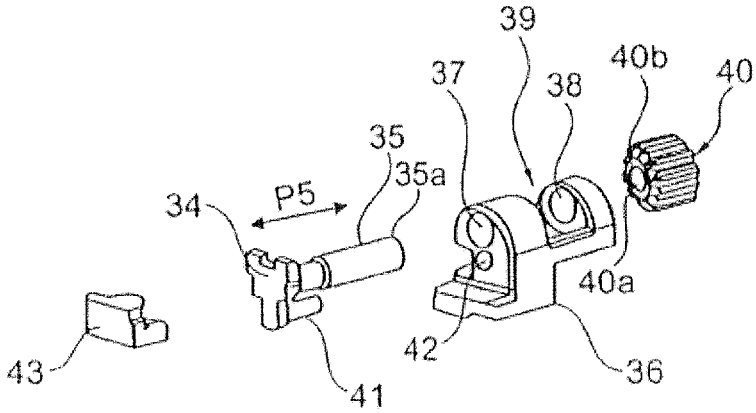
FIG. 8 shows an exploded illustration of the adjustment unit from FIG. 7.

FIGS. 7 and 8 show a third adjustment unit 33 according to the invention, in the assembled state in FIG. 7 and in an exploded illustration in FIG. 8. The adjustment unit 33 can be positioned on a furniture part, in principle, via a latching coupling according to FIGS. 1 and 5.

In contrast to the exemplary embodiments according to FIGS. 1 to 6, the adjustment unit 33, rather than having a resiliently deflectable stop tongue, has a longitudinally displaceable stop element 34, which is fixed to an adjustment bolt 35 and is guided on a basic body 36 of the adjustment unit 33. For this purpose, the adjustment bolt 35 is retained in through-passage bores 37 and 38 in the basic body 36. The through-passage bores 37, 38, which have identical diameters, are aligned with one another and are separated by an accommodating hollow 39, which is located therebetween and is intended for accommodating an adjustment wheel 40 of the adjustment unit 33. In the downwardly extending portion of the stop element 34, there is also a guide stub 41, which extends parallel to the adjustment bolt 35 and is guided for movement in a further bore 42 in the basic body 36. The guide stub 41 is long enough to be accommodated in further bore 42 over the entire possible displacement path of the stop element 34. Moreover, the guide stub 41 has a somewhat smaller diameter than the adjustment bolt 35.

A contact portion 43 is plugged on the stop element 34, in a manner corresponding to the stop tongues 4 and 31.

For displacement of the stop element 34, an external thread is provided on an outer lateral surface 35*a* of the adjustment bolt 35, this external thread being designed to match an internal thread 40*a* of a through-passage bore 40*b* in the adjustment wheel 40. By virtue of rotation brought about by manual operation of the adjustment wheel 40, the adjustment bolt 35, and thus the stop element 34, can be moved back and forth in the direction of the double arrow P5 in FIG. 8, and thereby defining a mechanical stop for the movable furniture part. Contact takes place by way of the contact portion 43.

LIST OF DESIGNATIONS

1 Latching coupling
2 Adjustment unit
3 Basic body
3*a* Base portion
4 Stop tongue (stop part)
5 Contact portion
6 Accommodating bore
7 Accommodating bore
8 Regulating screw (adjustment unit)
8*a* Outer lateral surface
9 Adjustment bolt
10 External thread
11 Internal thread
12 Engagement portion
13 Chamfer
14 Chamfer
15 Wedge-gear-mechanism arrangement
16 Contact nose
17 Fastening jaw
18 Fastening jaw
19 Fastening jaw
20 Adjustment unit
21 Basic body
22 Adjustment bolt
22*a* Threaded portion
22*b* Quadrilateral portion
23 Adjustment wheel
24 Accommodating hollow
26 Through-passage bore
27 Internal thread
28 Toothed portion
29 Quadrilateral hole
30 Accommodating opening
31 Stop tongue (stop part)
32 Contact portion
33 Adjustment unit
34 Stop element (stop part)

35 Adjustment bolt
35*a* Outer lateral surface
36 Basic body
37 Through-passage bore
38 Through-passage bore
39 Accommodating hollow
40 Adjustment wheel
40*a* Internal Thread
40*b* Through-passage bore
41 Guide stub
42 Bore
43 Contact portion
50 Moveable Furniture Part
51 Front Portion of Moveable Furniture Part
52 Underside of Moveable Furniture Part
55 Furniture rail structure
50 Side face of moveable furniture part
60 Basic Furniture Structure

I claim:

1. A device mounted on a piece of furniture that has a furniture part accommodated in a movable manner on a basic furniture structure comprising: an adjustment unit having an adjustable stop part, which bounds a furniture-part closing movement executed during normal operation, said device defining a stop position of the moveable furniture part, wherein the stop part is deflected resiliently out of a starting position during adjustment of the stop part, and wherein the stop position is determined by the extent of deflection in a fixed deflecting position of the stop part.

2. The device as claimed in claim 1, wherein the extent of deflection of the stop part can be predetermined by a changeable-position regulating element which acts on the stop part.

3. The device as claimed in claim 1, wherein the adjustment unit comprises a basic body with the stop part formed resiliently thereon and a regulating element guided on the basic body.

4. The device as claimed in claim 1, further comprising an operating element, which is mounted for rotation about an axis of rotation, wherein rotation of the operating element causes displacement of a regulating element.

5. The device as claimed in claim 4, further comprising a first threaded portion present on the operating element and a second threaded portion present on the regulating element, these two threaded portions being coordinated with one another in order to change the position of the regulating element when the operating element is rotated.

6. The device as claimed in claim 4, wherein the operating element and the regulating element are coordinated with one another such that the axis of rotation of the operating element is oriented parallel to the displacement axis of the regulating element.

7. The device as claimed in claim 1, wherein an operating element and a regulating element are coordinated with one another such that an axis of rotation of the operating element runs transversely to a displacement direction of the regulating element.

8. The device as claimed in claim 1, further comprising a wedge-gear-mechanism arrangement, via which a rotary movement of an operating element can be converted into an adjustment movement of a regulating element.

9. The device as claimed in claim 1, wherein the adjustment unit comprises a rotatable operating element by means of which the stop part, which is accommodated in a displaceable manner, can be adjusted, and wherein an axis of rotation of the operating element is oriented in a direction of displacement of the stop part.

10. The device as claimed in claim 9, further comprising a rotation-prevention means provided for the stop part, which is accommodated in a displaceable manner.

11. The device as claimed in claim 1, further comprising a releasably fitted contact portion present on the stop part, this contact portion coming into stopping contact, in a stopping situation, with an abutment portion.

* * * * *